US005906730A

United States Patent [19]

Hatanaka et al.

[11] Patent Number: 5,906,730

[45] Date of Patent: May 25, 1999

[54] PROCESS FOR DESULFURIZING CATALYTICALLY CRACKED GASOLINE

[75] Inventors: Shigeto Hatanaka, Kanagawa; Satoru Hikita; Osamu Sadakane, both of Tokyo; Tadao Miyama, Kanagawa, all of Japan

[73] Assignee: Mitsubishi Oil Co., Ltd., Tokyo, Japan

[21] Appl. No.: 08/686,037

[22] Filed: Jul. 25, 1996

[30] Foreign Application Priority Data

Jul. 26, 1995 [JP] Japan ..... 7-209304

[51] Int. Cl.[6] ..... C10G 45/06

[52] U.S. Cl. ..... 208/210; 208/209; 208/212; 208/213

[58] Field of Search ..... 208/210, 209, 208/213, 212

[56] References Cited

U.S. PATENT DOCUMENTS

| | | | |
|---|---|---|---|
| 3,349,027 | 10/1967 | Carr et al. | 208/210 |
| 3,732,155 | 5/1973 | Cecil et al. | 208/212 |
| 3,884,797 | 5/1975 | Alley, Jr. et al. | 208/210 |
| 4,801,373 | 1/1989 | Corman et al. | 208/210 |
| 5,110,444 | 5/1992 | Haun et al. | 208/89 |
| 5,292,428 | 3/1994 | Harrison et al. | 208/208 R |

OTHER PUBLICATIONS

"Plant Processing of Natural Gas", Author:Petroleum Extension Service, p. 94, 1974–no month.

*Primary Examiner*—Walter D. Griffin
*Assistant Examiner*—Nadine Preisch
*Attorney, Agent, or Firm*—Sughrue, Mion, Zinn, Macpeak & Seas, PLLC

[57] ABSTRACT

A process for desulfurizing catalytically cracked gasoline containing sulfur compounds and olefin components, which comprises the steps of:

1) first desulfurizing the catalytically cracked gasoline in the presence of a hydrodesulfurization catalyst at a desulfurization rate of 60 to 90%, a reaction temperature of 200 to 350° C., a hydrogen partial pressure of 5 to 30 kg/cm$^2$, a hydrogen/oil ratio of 500 to 3,000 scf/bbl, and a liquid hourly space velocity of 2 to 10 1/hr, said first desulfuriing step comprising supplying a feed having a hydrogen sulfide vapor concentration of not more than 0.1% by volume, and 2) next desulfurizing the treated oil obtained in the first step in the presence of a hydrodesulfurization catalyst at a desulfurization rate of 60 to 90%, a reaction temperature of 200 to 300° C., a hydrogen partial pressure of 5 to 15 kg/cm$^2$, a hydrogen/oil ratio of 1,000 to 3,000 scf/bbl, and a liquid hourly space velocity of 2 to 10 1/hr, said second desulfurizing step comprising supplying a feed having a hydrogen sulfide vapor concentration of not more than 0.05% by volume. A reduction in octane number due to hydrogenation of olefin components is minimized while achieving a high desulfurization rate.

9 Claims, No Drawings

PROCESS FOR DESULFURIZING CATALYTICALLY CRACKED GASOLINE

FIELD OF THE INVENTION

This invention relates to a process for desulfurizing catalytically cracked gasoline. More particularly, it relates to a process for desulfurizing catalytically cracked gasoline containing sulfur compounds and olefin components in the presence of a catalyst.

BACKGROUND OF THE INVENTION

In the field of petroleum refining, catalytically cracked gasoline is a stock of high-octane number gasoline containing a certain amount of olefin components. Catalytically cracked gasoline is a gasoline fraction obtained by catalytically cracking a heavy petroleum fraction as a stock oil, such as a vacuum gas oil or an atmospheric residual oil, and recovering and distilling the catalytically cracked products. Catalytically cracked gasoline is a primary blending stock of automotive gasoline.

While some stock oils have a small sulfur content and may be subjected to catalytic cracking without treatment, a stock oil for catalytic cracking generally has a relatively high content of sulfur compounds. When an untreated stock oil having a high sulfur content is subjected to catalytic cracking, the resulting catalytically cracked gasoline also has a high sulfur content. Such a gasoline fraction having a high sulfur content would cause environmental pollution if used as a blending stock for automotive gasoline.

Consequently, the stock oil is usually subjected to a desulfurization process prior to catalytic cracking.

A hydrodesulfurization process has hitherto been carried out to achieve the above-mentioned desulfurization in the field of petroleum refining. A hydrodesulfurization process comprises contacting a stock oil that is to be desulfurized with an appropriate catalyst for hydrodesulfurization in a pressurized hydrogen atmosphere at a high temperature.

Catalysts used for hydrodesulfurizing a stock oil for catalytic cracking (e.g., a vacuum gas oil or an atmospheric residual oil) comprise a group VI element (e.g., chromium, molybdenum and tungsten) and a group VIII element (e.g., cobalt and nickel) supported on an appropriate carrier (e.g., alumina). The hydrodesulfurization process is usually conducted at a temperature of about 300 to 400° C., a hydrogen partial pressure of about 30 to 200 kg/cm$^2$, and a liquid hourly space velocity (hereinafter abbreviated as LHSV) of about 0.1 to 10 1/hr.

In the case of hydrodesulfurizing a heavy petroleum fraction, such as a vacuum gas oil or an atmospheric residual oil, which is a stock oil for catalytic cracking, the processing is carried out at a high temperature and high pressure as stated above. Therefore, strict conditions are imposed on apparatus design, thereby incurring high construction costs. Also, in some cases an undesulfurized stock oil is subjected to catalytic cracking as described above. Even in cases where a stock oil is desulfurized prior to catalytic cracking, there has been a tendency to enhance the catalytic cracking apparatus without adequately desulfurizing the stock oil.

Catalytically cracked gasoline obtained from a desulfurized stock oil contains sulfur in an amount of 30 to 300 ppm by weight (in the whole fraction) and that obtained from an undesulfurized stock oil contains as much as 50 to several thousand ppm sulfur by weight (in the whole fraction). Under these circumstances, there is increasing difficulty in complying with present day environmental regulations.

Catalytically cracked gasoline can be directly subjected to hydrodesulfurization. In this case, however, the olefin components present in the cracked gasoline fraction are hydrogenated to reduce the olefin content, and the resulting cracked gasoline fraction has a reduced octane number. The reduction in octane number is significant when a high rate of desulfurization is required.

Sulfur compounds contained in catalytically cracked gasoline include thiophenes, thiacyclopalkanes, thiols and sulfides. The proportion of thiophenes is large, while the proportions of thiols and sulfides are small.

Sulfur is removed as hydrogen sulfide by desulfurization, but hydrogen sulfide in the gaseous phase reacts with olefins in the catalytically cracked gasoline to produce thiols. In order to attain a certain minimum rate of desulfurization, olefins should be hydrogenated to prevent the production of thiols. Thus, a high desulfurization rate cannot be obtained without being accompanied with a further reduction in octane number.

If catalytically cracked gasoline is desulfurized while its olefin components remain non-hydrogenated, thiols are unavoidably produced. Because thiols are corrosive, they must be made non-corrosive. This is done by converting the thiols to disulfides by a catalytic reaction, which necessitates installation of a sweetening apparatus.

Catalysts used for hydrodesulfurization of catalytically cracked gasoline containing sulfur compounds and olefin components comprise a group VIII element (e.g., cobalt and nickel) and a group VI element (e.g., chromium, molybdenum and tungsten) supported on an appropriate carrier (e.g., alumina) similar to other desulfurization catalysts. These catalysts are activated by preliminarily sulfiding in the same manner as used for treating desulfurization catalysts for naphtha. That is, naphtha is mixed with a sulfur compound, such as dimethyl disulfide, and the mixture is heated to 150 to 350° C. together with hydrogen and passed through a reaction tower packed with the catalyst. The sulfur compound, e.g., dimethyl disulfide, is converted to hydrogen sulfide by reacting with hydrogen at the surface of the active metal of the catalyst. The hydrogen sulfide is further reacted with the active metal to form a metal sulfide active in the desulfurization reaction.

Thus, a reduction in octane number due to hydrogenation of olefins has been a great problem in hydrodesulfurization of catalytically cracked gasoline. There has been a need to develop a technique of efficiently hydrodesulfurizing catalytically cracked gasoline while minimizing the reduction of olefin components.

To meet this demand, the reaction between hydrogen sulfide resulting from desulfurization and olefins must be controlled to thereby control the formation of thiols. However, an increase in desulfurization rate leads to an increase in hydrogen sulfide concentration in the gas phase, resulting in acceleration of thiol formation. In other words, it has conventionally been difficult to achieve a high desulfurization rate while suppressing the hydrogenation reaction of olefins. Rather, it has been necessary to hydrogenate olefins in order to prevent the same from producing thiols to thereby increase the desulfurization rate, which in turn results in a reduction in octane number.

SUMMARY OF THE INVENTION

An object of the present invention is to provide a process for hydrodesulfurizing catalytically cracked gasoline while suppressing hydrogenation of olefin components to minimize a reduction in octane number and yet achieve a high rate of desulfurization.

As a result of extensive investigation, the present inventors have discovered an innovative process for hydrodesulfurizing catalytically cracked gasoline containing sulfur compounds and olefin components in which hydrogenation of olefins is controlled to minimize a reduction in octane number and yet a high desulfurization rate is achieved. The process is characterized by dividing a hydrodesulfurization process that has hitherto been carried out in a single stage into two or more divided stages, each under specific reaction conditions, so that the reaction may proceed on a gradual basis.

The invention provides a process for desulfurizing catalytically cracked gasoline containing sulfur compounds and olefin components to reduce the sulfur content to a target concentration, which comprises the steps of:

1) first desulfurizing the catalytically cracked gasoline in the presence of a hydrodesulfurization catalyst at a desulfurization rate of 60 to 90%, a reaction temperature of 200 to 350° C., a hydrogen partial pressure of 5 to 30 kg/cm$^2$, a hydrogen/oil ratio of 500 to 3,000 scf/bbl and a liquid hourly space velocity (hereinafter abbreviated as LHSV) of 2 to 10 1/hr, said first desulfurizing step comprising supplying a feed having a hydrogen sulfide vapor concentration of not more than 0.1% by volume, and
2) desulfurizing the treated oil obtained in the first step in the presence of a hydrodesulfurization catalyst at a desulfurization rate of 60 to 90%, a reaction temperature of 200 to 300° C., a hydrogen partial pressure of 5 to 15 kg/cm$^2$, a hydrogen/oil ratio of 1,000 to 3,000 scf/bbl, and an LHSV of 2 to 10 1/hr, and said second desulfurizing step comprising supplying a feed having a hydrogen sulfide vapor concentration of not more than 0.05% by volume.

In a preferred embodiment, the process further comprises repeating the second desulfurizing step until the sulfur concentration is reduced to a target concentration when the sulfur concentration of the treated oil obtained in the second step is higher than the target concentration.

DETAILED DESCRIPTION OF THE INVENTION

The language "hydrogen sulfide concentration at the inlet of a reactor" as used herein means the percent by volume of hydrogen sulfide in the vapor of a stock oil at the inlet of a reactor. The term "hydrogen partial pressure" means the partial pressure of hydrogen in the vapor of a stock oil at the inlet of a reactor.

The first step of the process according to the invention includes hydrodesulfurizing most of the sulfur compounds present in catalytically cracked gasoline. The first step is carried out under special conditions characterized by a lower temperature, a lower pressure, and a higher hydrogen to oil ratio so as to minimize hydrogenation of olefins as compared with ordinary desulfurization of naphtha, etc. That is, with a permissible hydrogenation rate of olefins being taken into consideration, the reaction conditions are specifically selected so that the desulfurization rate is within a range of from 60 to 90%. Under reaction conditions which may attain a desulfurization rate of more than 90%, the formation of thiols could be suppressed by hydrogenation of olefins. However, the octane number would be reduced. If the desulfurization rate is less than 60%, the number of required steps increases, and this is uneconomical. The reaction temperature and the contact time are selected so that the desulfurization rate is within the range of from 60 to 90% by weight. The lower reaction temperature tends to prevent olefin hydrogenation. However, desulfurization at temperatures below 200° C. is too slow for practical use. At temperatures above 350° C., deactivation of the catalyst is accelerated.

As the hydrogen/oil ratio increases, hydrogen sulfide is diluted so that formation of thiols is further suppressed. However, a range of from 500 to 3,000 scf/bbl is practical in view of the size of the apparatus. Because the hydrogen sulfide concentration during the reaction should be low, the hydrogen sulfide concentration at the inlet of a reactor is desirably not more than 0.1% by volume. To this effect, hydrogen sulfide in recycled hydrogen gas may be removed by means of, for example, an amine absorbing apparatus. Use of the amine absorbing apparatus can reduce the hydrogen sulfide concentration to about 0.01% by volume. The gas separated by gas-liquid separation after each step of the second and the following steps, so-called recycled gas, has a low hydrogen sulfide concentration. As long as the hydrogen sulfide concentration of the recycled gas is 0.1% by volume or lower, the recycled hydrogen can be fed to the first step without passing through an amine absorbing apparatus. It is preferable to select the reaction conditions of the first step so that the hydrogenation rate of olefins does not exceed 20%, to thereby minimize the reduction in octane number.

The desulfurized catalytically cracked gasoline obtained from the first step is separated into gas and liquid, and the liquid is further desulfurized in the second step. In the second step, the remaining undecomposed sulfur compounds are hydrogenolyzed and, at the same time, the thiols produced in the first step are also hydrogenolyzed to achieve desulfurization. The second step may be carried out under milder conditions than those employed in the first step because thiols are relatively easy to desulfurize. However, the second step is preferably carried out at an increased hydrogen/oil ratio and a reduced reaction pressure in order to suppress production of thiols due to the reaction between the olefins and hydrogen sulfide. That is, the preferred reaction conditions are a reaction temperature of 200 to 300° C., a hydrogen partial pressure of 5 to 15 kg/cm$^2$, a hydrogen/oil ratio of 1,000 to 3,000 scf/bbl, and an LHSV of 2 to 10 1/hr. The hydrogen sulfide concentration at the inlet of a reactor is preferably not more than 0.05% by volume. To this effect, hydrogen sulfide in recycled hydrogen gas should be removed by means of an amine absorbing apparatus, etc. The gas separated by gas-liquid separation after the reaction of the first step may be recycled to the second step after it has been passed through an amine absorbing apparatus.

The reaction conditions of the second step should be controlled so that the desulfurization rate is within a range of from 60 to 90% in order to prevent a reduction in octane number. It is preferable to select the reaction conditions of the first step so that the hydrogenation rate of olefins does not exceed 20%, to thereby minimize the reduction in octane number.

When the sulfur concentration of the treated oil obtained in the second step is still higher than a target value, the treated oil is further desulfurized in a third step. The third step, in principle, is a repetition of the second step, in which the desulfurization operation is repeated at a desulfurization rate of 60 to 90% until the sulfur concentration is reduced to the target value. Suppression in the reduction of octane number, which is a characteristic feature of the invention, can surely be by controlling the overall hydrogenation rate of the olefin components from the first to the final steps at 40% or less. It is preferable to repeat the desulfurization until the sulfur concentration from thiols in catalytically cracked gasoline becomes 5 wt ppm or less. In this case, the corrosive property catalytically cracked gasoline can be substantially eliminated so that a sweetening apparatus is not necessary.

A process comprising carrying out desulfurization in divided steps has been proposed for fractions having a high sulfur content but no olefin components, such as gas oil, for the purpose of improving the hue of a treated oil, as disclosed in Unexamined Published Japanese Patent Appln. No. 5-78670. The present invention provides a desulfurization process which is novel and entirely different from the conventional multistage desulfurization process developed to improve the hue. That is, a multistage system is adopted in the invention to prevent the generation of thiols as a by-product due to the reaction between olefins and hydrogen sulfide, in which the reaction conditions in each stage are specified so as to minimize the hydrogenation of olefin components.

The catalyst for use in the invention includes those ordinarily used for hydrodesulfurizing in the field of petroleum refining, which generally comprise a desulfurization active metal supported on a porous inorganic oxide carrier.

The porous inorganic oxide carrier includes alumina, silica, titania, magnesia, and mixtures thereof. Alumina and silica-alumina are preferred.

A catalyst containing an alkali metal (e.g., potassium) in the carrier for preventing coke precipitation is also much preferred for use in the invention.

The desulfurization active metal includes chromium, molybdenum, tungsten, cobalt, nickel, and mixtures thereof. Cobalt-molybdenum and nickel-cobalt-molybdenum are preferred. These metals can be in the form of a metal, an oxide, a sulfide or a mixed form thereof on the carrier. The active metal can be supported on the carrier by a known method, such as impregnation or co-precipitation.

While the reaction tower is not particularly limited, a fixed bed parallel downward flow type reactor is preferred. The operation of various types of reaction towers is well known in the field of petroleum refining, and known techniques can be selected as appropriate.

The present invention will now be illustrated in greater detail by way of the following Examples, but it should be understood that the invention is not limited thereto.

EXAMPLE 1

A small-sized fixed bed parallel downward flow type reactor was charged with 100 ml of a commercially available extrusion-molded catalyst (1/16 in.) comprising an alumina carrier having supported thereon 4.0% by weight of CoO and 15% by weight of $MoO_3$. A straight-run gasoline fraction (distillation temperature: 30 to 150° C.) having added thereto 5% by weight of dimethyl disulfide was passed through the catalyst bed at a temperature of 300° C., a pressure of 15 kg/cm$^2$, an LHSV of 2 1/hr, and a hydrogen/oil ratio of 500 scf/bbl for 5 hours to conduct preliminary sulfiding.

1) First Step:

A catalytically cracked gasoline fraction (an 80 to 220° C. cut) was obtained by catalytically cracking a stock oil containing an atmospheric residual oil. The fraction had a density of 0.779 g/cm$^3$ at 15° C., a sulfur content of 220 wt ppm, an olefin content of 32 vol %, and a research method octane number of 87.1. After sulfiding the catalyst bed as described above, the catalytically cracked gasoline fraction was desulfurized in the reactor at a hydrogen sulfide concentration of 0.05 vol % at the inlet of the reactor, a temperature of 250° C., an LHSV of 5 1/hr, a hydrogen partial pressure of 12 kg/cm$^2$, and a hydrogen/oil ratio of 2,000 scf/bbl.

As a result, a hydrodesulfurized catalytically cracked gasoline fraction was obtained having a sulfur content from (contributed by) thiols (hereinafter referred to as a thiol sulfur content) of 12 wt ppm, a total sulfur content of 63 wt ppm (desulfurization rate: 71%), an olefin content of 29 vol % (hydrogenation rate: 9%), and a research method octane number of 86.0.

2) Second Step:

The treated oil obtained in the first step was again desulfurized under the same conditions as in the first step, except for changing the hydrogen sulfide concentration at the inlet of the reactor to 0.03 vol %. As a result, a hydrodesulfurized catalytically cracked gasoline fraction was obtained, having a thiol sulfur content of 9 wt ppm, a total sulfur content of 21 wt ppm (desulfurization rate: 67%), an olefin content of 27 vol % (hydrogenation rate: 7%), and a research method octane number of 85.3.

3) Third Step:

The treated oil obtained in the second step was further desulfurized under the same conditions as in the second step. As a result, a hydrodesulfurized catalytically cracked gasoline fraction was obtained, having a thiol sulfur content of 3 wt ppm, a total sulfur content of 8 wt ppm (desulfurization rate: 63%), an olefin content of 24 vol % (hydrogenation rate: 11%), and a research method octane number of 84.5.

The overall desulfurization rate from the first step through the third step was 95%, and the overall hydrogenation rate of olefins was 25%.

COMPARATIVE EXAMPLE 1

The same catalyst that was used in the reactor of Example 1was preliminarily sulfided in the same manner as in Example 1. The same catalytically cracked gasoline fraction as used in Example 1 was desulfurized in the reactor under the same reaction conditions as in Example 1, except for raising the reaction temperature by 30° C., i.e., to 280° C. As a result, a hydrodesulfurized catalytically cracked gasoline fraction was obtained, having a thiol sulfur content of 7 wt ppm, a total sulfur content of 15 wt ppm (desulfurization rate: 93%), an olefin content of 18 vol % (hydrogenation rate: 43%), and a research method octane number of 82.1.

As described above, the present invention is characterized in that hydrodesulfurization of catalytically cracked gasoline containing sulfur compounds and olefin components is carried out in divided steps under specific conditions. According to the invention, hydrogenation of the olefin components is suppressed to thereby minimize a reduction in octane number.

While the invention has been described in detail and with reference to specific examples thereof, it will be apparent to one skilled in the art that various changes and modifications can be made therein without departing from the spirit and scope thereof.

What is claimed is:

1. A process for desulfurizing catalytic cracked gasoline containing sulfur compounds and olefin components, which comprises the steps of:

1) supplying a catalytically cracked gasoline feed having a hydrogen sulfide vapor concentration of not more than 0.1% by volume to a first desulfurizing step, wherein 60 to 90% by weight of the catalytically cracked gasoline feed is desulfurized, wherein the catalytically cracked gasoline feed is contacted with a cobalt-molybdenum/alumina catalyst at a reaction temperature of 200 to 350° C., a hydrogen partial pressure of 5 to 30 kg/cm$^2$, a hydrogen/oil ratio of 500 to 3,000 scf/bbl and a liquid hourly space velocity of 2 to 10 1/hr, and 2) supplying a feed from the first desulfurizing step having a hydrogen sulfide vapor concentration of not more than 0.05% by volume to a second desulfurizing step wherein 60 to 90% by weight of the feed from the first desulfurizing step is desulfurized by contacting the feed with a cobaltmolybdenum/alurnina catalyst at a reaction temperature of 200 to 300° C., a hydrogen partial pressure of 5 to 15 kg/cm$^2$, a hydrogen/oil ratio of 1,000 to 3,000 scf/bbl and a liquid hourly space velocity of 2 to 10 1/hr.

2. The process according to claim 1, wherein the hydrogenation % by weight of olefin components in each of said desulfurization steps 1) and 2) is not more than 20%, by weight and the overall hydrogenation % of olefin components after all desulfurizing steps is not more than 40% by weight.

3. The process according to claim 1, wherein the sulfur content from thiols of the treated oil after all desulfurizing steps is not more than 5 ppm by weight.

4. The process according to claim 1, further comprising the step of repeating the second desulfurizing step until the sulfur concentration of the treated oil is reduced to a target concentration.

5. The process according to claim 4, wherein the hydrogenation % of olefin components in each of said desulfurization steps 1) and 2) is not more than 20%, and the overall hydrogenation rate of olefin components after all desulfurizing steps is not more than 40%.

6. The process according to claim 4, wherein the sulfur content from thiols of the treated oil after all desulfurizing steps is not more than 5 ppm by weight.

7. The process according to claim 1, further comprising the steps of separating the product of the first desulfurization step into a gas component and a liquid component, removing hydrogen sulfide from the gas component to a concentration of not more than 0.05% by volume, and supplying the treated gas component to the second desulfurization step.

8. The process according to claim 7, wherein said removing step comprises treating the gas component in an amine absorbing apparatus.

9. The process according to claim 1, further comprising the steps of separating the product of the second desulfurization step into a gas component and a liquid component, and supplying the gas component to the first desulfurization step.

* * * * *